United States Patent [19]

Mandras

[11] 4,045,837

[45] Sept. 6, 1977

[54] MACHINE FOR POLISHING RODS OR WIRES

[75] Inventor: Christian Maurice Mandras, Revigny-sur-Ornain, France

[73] Assignee: Societe Metallurgique de Revigny, Revigny-sur-Ornain, France

[21] Appl. No.: 654,498

[22] Filed: Feb. 2, 1976

[30] Foreign Application Priority Data

Feb. 13, 1975 France ..... 75.04450

[51] Int. Cl.[2] ..... B08B 9/02; B24B 39/04

[52] U.S. Cl. ..... 15/104.04; 15/97 R; 15/88; 29/90.5; 51/90

[58] Field of Search ..... 15/88, 97 R, 104.04; 29/90.5; 51/90, DIG. 10

[56] References Cited

U.S. PATENT DOCUMENTS 2,349,897 5/1944 Wilson ..... 15/88 UX

*Primary Examiner*—Edward L. Roberts

*Attorney, Agent, or Firm*—Sughrue, Rothwell, Mion, Zinn and Macpeak

[57] ABSTRACT

The machine comprises in combination a fixed frame and a hollow tubular element rotatable in the frame. The rod to be polished extends axially through the tubular element. A pressure-applying device actuated by centrifugal force and pivoted to the tubular element applies polishing means radially against the rod as the device rotates. Means are provided for driving the tubular element in rotation.

9 Claims, 2 Drawing Figures

1
2
3
4
5
6
7
8
9
10
11
12
13
14
15
16
17
18
19
20
21
22
23
24
25
2

7
10
11
12
13
14
15
16

MACHINE FOR POLISHING RODS OR WIRES

The present invention relates to machines for polishing bars, rods or wires of metal.

The term "rod" employed in the present description is intended to designate generally products obtained by drawing, for example also bars or wires.

It is desirable to be able to incorporate such machines in a continuous drawing installation but this is impossible with present-day machines owing to the fact that the rods must rotate about their axis.

An object of the present invention is to provide a machine for polishing metal rods which does not have the drawbacks of machines of known type and are moreover capable of being incorporated in a continuous drawing installation and through which machine the rod or bar to be polished can travel axially without rotating about its own axis.

According to the invention, there is provided a machine for polishing metal rods comprising in combination a fixed frame, a hollow tubular element which is mounted to be rotatable in the frame and through which element the rod to be polished extends coaxially in a slidable and non-rotary manner, a pressure-applying device actuated by centrifugal force and pivoted to the tubular element, movable polishing means pivoted to the device to be radially applicable against the rod, while rotating, by said device, and means for driving said element in rotation.

According to one embodiment of the invention, the pressure-applying device is of the type employing weights and comprises a first link carrying a slidable weight and pivoted at one end to a second link whose opposite end is pivoted to a slidable support connected to rotate with the tubular element, the first link carrying polishing means which are pivoted to the end of the first link opposed to the second link, the first link being pivoted to a radial projection of the tubular element at a point located in the vicinity of said polishing means between the polishing means and the second link.

Preferably, a return spring is disposed around the tubular element between the slidable support and an abutment adjustable on the tubular element.

Advantageously, the projection of the tubular element is constituted by a cylindrical portion of the tubular element having an enlarged diameter and including at least one radial slot in which the polishing means are slidably mounted.

Figure 1:
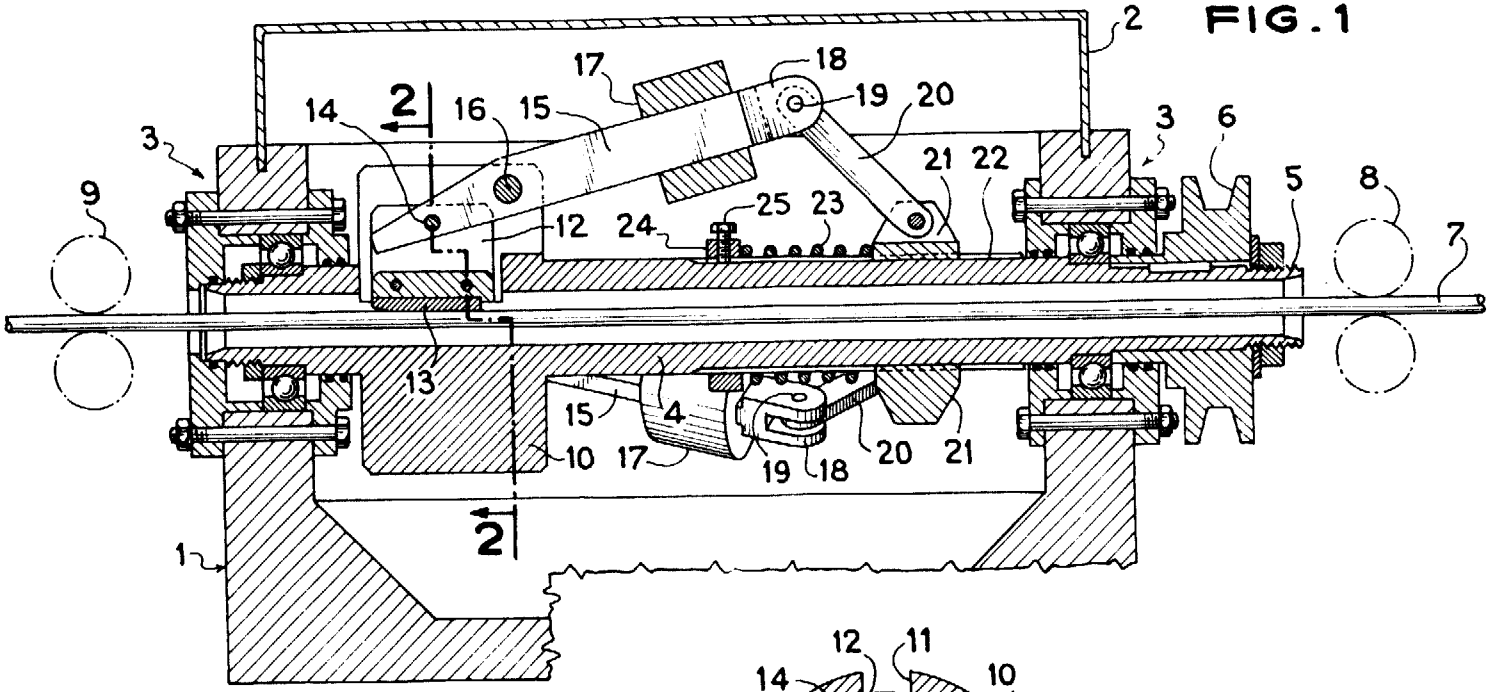
Figure 2:
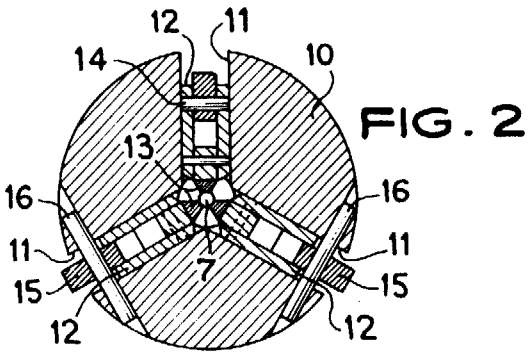

Further features and advantages of the invention will be apparent from the ensuing description with reference to the accompanying drawings, in which:

FIG. 1 is a longitudinal sectional view of a machine for polishing metal rods according to the invention, and FIG. 2 is a partial sectional view taken on line 2—2 of FIG. 1.

The machine shown in FIG. 1 comprises a support frame 1 preferably having four lateral walls and capable of being closed by a detachable hood 2.

Two opposite walls of the frame have openings in which there are disposed rolling bearing assemblies 3 which carry an elongated hollow tubular element 4 so that the element can rotate in the bearing assemblies.

One end 5 of the element 4 extends outside the frame 1 and has keyed thereon suitable driving means, for example a pulley 6.

A metal rod 7 which may come, for example, from a continuous drawing installation (not shown), extends coaxially through the tubular element 4 in which it is axially movable, this rod being driven by pinching or gripping rollers 8 and 9.

It will be observed that, owing to the action of the pinching rollers 8 and 9, the rod 7 cannot rotate about its axis.

The tubular element 4 carries a pressure-applying device actuated by centrifugal force and having inertia weights or masses. The element 4 has for this purpose, in the vicinity of the end thereof opposed to the pulley 6, and inside the frame, a cylindrical portion 10 of larger diameter which is in one piece with the element 4 or secured thereto.

The part 10 has radial slots 11 (shown to be three in number) which are angularly equally spaced apart and extend axially roughly throughout its length and throughout the radial extent of the part 10 so as to open onto the outer surface of the part 10 and onto the inner surface of the element 4.

In each of these slots there is radially slidably mounted a movable member 12 having at its inner end a pad or shoe 13 of polishing material whose surface is parallel to the axis of the rod 7.

Each movable member 12 is guided in its corresponding slot 11 and has in the vicinity of its radially outer surface a pin 14 on which there is pivotally mounted one end of a link 15 which extends in a direction parallel to the rod 7.

The link 15 is pivotally mounted at a point nearer to the pin 14 than its opposite end, on a pin 16 fixed in the part 10 and carries a slidable mass or weight 17 whose position on the length of the link 15 may be adjusted and fixed by means of a set-screw (not shown). The opposite end of the link 15 has the shape of a fork 18 in which one end of a second link 20 is pivoted by means of a pin 19.

The opposite end of the link 20 is itself pivoted to support means constituted by a collar 21 surrounding the tubular element 4 on which latter it is axially slidable.

The collar 21 has on its inner surface splines which are engaged with corresponding longitudinal splines 22 provided on the outer surface of the tubular element 4 so that the collar 21 is rotatable with the tubular element 4.

Disposed between the collar 22 and the part 10 of the element 4 and around the latter, is a coil spring 23 which bears against an abutment 24 which is slidable on the element 4 and fixed in position by means of a set-screw 25.

It will be understood that the machine has an assembly of links 15, 20 corresponding to each slot 11 of the part 10.

The machine just described operates in the following manner:

When the tubular element 4 is driven in rotation about the rod 7 by means of a motor (not shown), through the pulley 6, the assembly comprising the links 20 and 15, the inertia weights 17 and the collar 21 act as a centrifugal governor device, with the masses 17 tending to move away from the axis of the tubular element 4, the collar 21 sliding on the latter toward the part 10 and the links 15 pivoting about the pins 16 and applying a pressure on the elements 12 which urge the pads 13 against the rod 7 which is prevented from moving by the pinching rollers 8 and 9.

It will be understood that this pressure is a function of a number of factors which are: the speed of rotation, the position of the weights 17 on the links 15 and the opposing action of the spring 23 on the collar 21.

The pressure applied by this device is extremely even and can thus be adjusted with very high precision.

In operation, the rod 7 to be polished can be driven or fed axially by means of the pinching rollers 8 and 9, for example continuously if the machine is mounted in a drawing installation, and the machine can then be adjusted to produce a polish of very high quality continuously at speeds compatible with the rate of output of the rod 7 from the drawing bench.

For reasons of convenience, a graduation may be provided on the links 15 to allow a uniform and precise adjustment of the masses or weights 17. Another graduation may be provided on the tubular element 4 to facilitate the adjustment of the abutment 24.

These adjusting means, combined with a control of the speed of the driving means connected to the pulley 6, enable high precision to be obtained.

Furthermore, the use of centrifugal force applied by means of lever arms permit employing weights 17 which are relatively small and consequently the inertia of the assembly of the machine is reduced as compared with known machines.

Having now described my invention what I claim as new and desire to secure by Letters Patent is:

1. A machine for polishing non-rotating rods or wires of metal, comprising in combination: a fixed frame, a hollow tubular element which is mounted to be rotatable in the frame and defining a bore for receiving the rod to be polished, which rod extends coaxially inside the element for axial movement through the element, pressure-applying means actuatable by centrifugal force and mounted on the tubular element, radially movable polishing means carried by the pressure-applying means to be radially applicable against the rod by the pressure-applying means, and means for driving the tubular element and the pressure-applying means in rotation, the pressure-applying means comprising a support mounted on the tubular element to rotate with the tubular element but to be axially movable relative to the tubular element, a plurality of first links equally spaced apart angularly about the tubular element, a pivot pin pivotably mounting each first link on the tubular element, the polishing means being pivotably mounted on each first link on one side of the pivot pin, a slidable weight carried by each first link on an opposite side of the pivot pin to said polishing means and as many second links as there are first links and respectively associated with said first links, each second link having one end portion pivoted to the support and an opposite end portion pivoted to a respective one of said first links on said opposite side of the pivot pin.

2. A machine as claimed in claim 1, comprising means defining a radial enlargement of the tubular element in the vicinity of an end of the tubular element, the pivot pin being located in the enlargement.

3. A machine as claimed in claim 2, wherein said enlargment has a radial outer periphery and there are provided radial slots in the enlargement which open onto said outer periphery and onto said bore, said polishing means comprising slidable members respectively guided in said slots, said slidable members carrying polishing material at radially inner ends of the slidable members, there being as many first links, second links and weights as there are slidable members.

4. A machine as claimed in claim 2, comprising an abutment which is axially adjustable in position on the tubular element, between the enlargement and the support, and a return compression spring disposed between and engaging the support and the abutment.

5. A machine as claimed in claim 4, comprising graduations on the tubular element to permit an adjustment of the position of the abutment.

6. A machine as claimed in claim 1, wherein the tubular element has outer axial splines and the slidable support is an annular collar surrounding the tubular element and has inner axial splines engaged with the axial splines provided on the tubular element.

7. A machine as claimed in claim 4, wherein the weight is slidable on the first link between the pivot pin and the second link.

8. A machine as claimed in claim 4, comprising graduations on the first link to permit an adjustment of the position of the slidable weight.

9. A machine for polishing non-rotating rods or wires of metal, comprising in combination: a fixed frame, a hollow tubular element which is mounted to be rotatable in the frame about an axis and defining a bore for receiving the rod to be polished, which rod extends coaxially inside the element for axial movement through the element, pressure-applying means actuatable by centrifugal force and mounted on the tubular element, radially movable polishing means carried by the pressure-applying means to be radially applicable against the rod by the pressure-applying means, and means for driving the tubular element and the pressure-applying means in rotation, the pressure applying means comprising a plurality of links equally spaced apart angularly about the tubular element, pivot means pivotally mounting the links on the tubular element so that the links are movable in radial planes intersecting on said axis, the polishing means being pivotally mounted on each link on one side of said pivot means, a weight carried by each link on an opposite side of said pivot means to said polishing means, abutment means mounted to be adjustable in position axially of the tubular element, means for securing the abutment means in an adjusted position, a member mounted to be axially movable axially of the tubular element toward and away from the abutment means, connecting means connecting each of the links to said member for shifting said member in a given direction when said opposite sides of the links move radially outwardly about said pivot means and elastically yieldable means interposed between and engaging the abutment means and said member to be stressed by movement of said member in said given direction.

* * * * *